US010941460B2

(12) United States Patent
Park et al.

(10) Patent No.: US 10,941,460 B2
(45) Date of Patent: Mar. 9, 2021

(54) PLATED STEEL PLATE AND MANUFACTURING METHOD THEREOF

(71) Applicant: Hyundai Steel Company, Incheon (KR)

(72) Inventors: Jin Sung Park, Asan-Si (KR); Sun Hwan Kwon, Dangjin-Si (KR)

(73) Assignee: Hyundai Steel Company, Incheon (KR)

( * ) Notice: Subject to any disclaimer, the term of this patent is extended or adjusted under 35 U.S.C. 154(b) by 260 days.

(21) Appl. No.: 15/759,488

(22) PCT Filed: Jan. 14, 2016

(86) PCT No.: PCT/KR2016/000393
§ 371 (c)(1),
(2) Date: Mar. 12, 2018

(87) PCT Pub. No.: WO2017/051998
PCT Pub. Date: Mar. 30, 2017

(65) Prior Publication Data

US 2018/0265943 A1 Sep. 20, 2018

(30) Foreign Application Priority Data

Sep. 22, 2015 (KR) ..... 10-2015-0133839

(51) Int. Cl.
*C21D 9/46* (2006.01)
*C23C 2/06* (2006.01)
(Continued)

(52) U.S. Cl.
CPC ..... *C21D 9/46* (2013.01); *C21D 1/20* (2013.01); *C21D 6/002* (2013.01); *C21D 6/005* (2013.01);
(Continued)

(58) Field of Classification Search
CPC ..... C21D 9/46; C21D 8/0205; C22C 38/001
See application file for complete search history.

(56) References Cited

U.S. PATENT DOCUMENTS

2014/0170439 A1 6/2014 Allain et al.
2015/0075680 A1 3/2015 Tanaka et al.
2017/0191150 A1* 7/2017 Hanlon ..... C22C 18/00

FOREIGN PATENT DOCUMENTS

CN 103827336 A 5/2014
JP 2006307325 A 11/2006
(Continued)

OTHER PUBLICATIONS

IspatGuru (Cold Rolling of Steels, Oct. 8, 2014, https://www.ispatguru.com/cold-rolling-of-steels/) (Year: 2014).*
(Continued)

*Primary Examiner* — Christopher S Kessler
*Assistant Examiner* — Jiangtian Xu
(74) *Attorney, Agent, or Firm* — Locke Lord LLP

(57) ABSTRACT

A method for producing a coated steel sheet by reheating a steel slab containing 0.15-0.25 wt % of carbon (C), more than 0 wt % but not more than 1.5 wt % of silicon (Si), 1.5-2.5 wt % of manganese (Mn), more than 0 wt % but not more than 1.8 wt % of aluminum (Al), 0.3-1.0 wt % of chromium (Cr), more than 0 wt % but not more than 0.03 wt % of titanium (Ti), more than 0 wt % but not more than 0.03 wt % of niobium (Nb), and the balance of iron (Fe) and unavoidable impurities. Hot-rolling, cooling and coiling the steel slab, thereby producing a hot-rolled steel sheet. Pickling the hot-rolled steel sheet, then cold rolling. Annealing the cold-rolled steel sheet at a temperature between 820° C. and 870° C., followed by cooling at a finish-cooling temperature between 350° C. and 450° C.; tempering the cooled
(Continued)

steel sheet at a temperature between 450° C. and 550° C.; and hot-dip galvanizing the tempered steel sheet.

7 Claims, 2 Drawing Sheets

(51) Int. Cl.

| | |
|---|---|
| ***C23C 2/40*** | (2006.01) |
| ***C22C 38/26*** | (2006.01) |
| ***C22C 38/28*** | (2006.01) |
| ***C21D 8/02*** | (2006.01) |
| ***C21D 1/20*** | (2006.01) |
| ***C22C 38/38*** | (2006.01) |
| ***C22C 38/34*** | (2006.01) |
| ***C21D 6/00*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C23C 2/02*** | (2006.01) |
| ***C23F 17/00*** | (2006.01) |
| *C23G 1/00* | (2006.01) |

(52) U.S. Cl.

CPC ..... *C21D 6/008* (2013.01); *C21D 8/0205* (2013.01); *C21D 8/0226* (2013.01); *C21D 8/0236* (2013.01); *C21D 8/0247* (2013.01); *C21D 8/0263* (2013.01); *C21D 8/0278* (2013.01); *C21D 8/0284* (2013.01); *C22C 38/001* (2013.01); *C22C 38/002* (2013.01); *C22C 38/02* (2013.01); *C22C 38/04* (2013.01); *C22C 38/06* (2013.01); *C22C 38/26* (2013.01); *C22C 38/28* (2013.01); *C22C 38/34* (2013.01); *C22C 38/38* (2013.01); *C23C 2/02* (2013.01); *C23C 2/06* (2013.01); *C23C 2/40* (2013.01); *C23F 17/00* (2013.01); *C21D 8/02* (2013.01); *C21D 2211/001* (2013.01); *C21D 2211/002* (2013.01); *C21D 2211/005* (2013.01); *C21D 2211/008* (2013.01); *C23G 1/00* (2013.01)

(56) References Cited

FOREIGN PATENT DOCUMENTS

| | | | |
|---|---|---|---|
| JP | 2009185355 | A | 8/2009 |
| JP | 2010255094 | A | 11/2010 |
| JP | 2011168816 | A | 9/2011 |
| JP | 2013227653 | A | 11/2013 |
| KR | 100 573 587 | B1 | 4/2006 |
| KR | 20110067159 | A | 6/2011 |
| KR | 20110124078 | A | 11/2011 |
| KR | 101235535 | B1 | 2/2013 |
| KR | 20140083819 | A | 7/2014 |
| KR | 20140130492 | A | 11/2014 |
| KR | 20150025952 | A | 3/2015 |
| WO | 2014092025 | A1 | 6/2014 |
| WO | 2016/005061 | A1 | 1/2016 |

OTHER PUBLICATIONS

International Search Report issued by the Korean Intellectual Patent Office, as ISA, dated Jun. 20, 2016, in corresponding International Patent Application PCT/KR2016/000393.

First Office Action issued by the State Intellectual Property office of P.R. China, dated Nov. 7, 2018, issued in corresponding Chinese Patent Application No. 201680054091.4.

Reasons for Refusal Office Action, prepared by Examiner Tomoki Shizuno, of the Japanese Patent Office, dated Nov. 20, 2018, issued in corresponding Japanese Patent Application No. 2018-511409.

John G Speer et al., "Analysis of Microstructure Evolution in Quenching and Partitioning Automotive Sheet Steel", Metallurgical and Materials Transactions A, vol. 42A, Dec. 2011, pp. 3591-3601. (cited in the Apr. 30, 2019 Search Report issued for EP168 8724.7).

Supplementary European Search Report dated Apr. 30, 2019, issued for the European patent application No. 16848724.7.

* cited by examiner

PLATED STEEL PLATE AND MANUFACTURING METHOD THEREOF

CROSS REFERENCE TO RELATED APPLICATIONS

This application is the national phase under 35 U.S.C. 071 of PCT International Application PCT/KR2016/000393, filed Jan. 14, 2016 which claims the benefit of and priority to Korean Patent Application 10-2015-0133839 filed Sep. 22, 2015. The entire contents of this patent application are hereby incorporated by reference herein.

TECHNICAL FIELD

The present invention relates to a coated steel sheet and a production method thereof. More specifically, the present invention relates to a coated steel sheet having excellent crash energy absorption properties and formability and to a method for producing the same.

BACKGROUND ART

In recent years, there has been an increasing demand for vehicles having enhanced safety and a lightweight structure. In response to this demand, efforts have been made to increase the strengths of materials that are applied to vehicle bodies. However, generally, as the strength of steel sheets increases, the elongation thereof decreases. Thus, when steel sheets have a certain strength or higher, the formation of the sheet sheets into draw parts reaches a limit. Thus, efforts to increase the elongation of steel sheets have also been made together with the above-described efforts to increase the strength of steel sheets. This increase in elongation can expand the application of draw parts, and can enhance the impact energy absorption ability (TS*EI) of draw parts, making it possible to enhance the crash energy absorption properties of the draw parts when being applied to vehicle bodies.

Prior art documents related to the present invention include Korean Unexamined Patent Application Publication No. 2015-0025952 (published on Mar. 11, 2015; entitled "High-Strength Hot-Rolled Coated Steel Sheet and Production Method Thereof").

DISCLOSURE

Technical Problem

In accordance with an embodiment of the present invention, there is provided a method for producing a coated steel sheet having excellent mechanical strength properties such as crash energy absorption properties.

In accordance with another embodiment of the present invention, there is provided a method for producing a coated steel sheet having excellent formability.

In accordance with still another embodiment of the present invention, there is provided a coated steel sheet produced by the above-described method for producing the coated steel sheet.

Technical Solution

One aspect of the present invention is directed to a method for producing a coated steel sheet. In one embodiment, the method for producing the coated steel sheet includes the steps of: reheating a steel slab containing 0.15-0.25 wt % of carbon (C), more than 0 wt % but not more than 1.5 wt % of silicon (Si), 1.5-2.5 wt % of manganese (Mn), more than 0 wt % but not more than 1.8 wt % of aluminum (Al), 0.3-1.0 wt % of chromium (Cr), more than 0 wt % but not more than 0.03 wt % of titanium (Ti), more than 0 wt % but not more than 0.03 wt % of niobium (Nb), and the balance of iron (Fe) and unavoidable impurities; hot-rolling, cooling and coiling the steel slab, thereby producing a hot-rolled steel sheet; pickling the hot-rolled steel sheet, followed by cold rolling; annealing the cold-rolled steel sheet at a temperature between 820° C. and 870° C., followed by cooling at a finish-cooling temperature between 350° C. and 450° C.; tempering the cooled steel sheet at a temperature between 450° C. and 550° C.; and hot-dip galvanizing the tempered steel sheet.

In one embodiment, the cold rolling may be performed at a reduction ratio of 50-80%.

In one embodiment, the steel sheet may be cooled at a cooling rate of 10-50° C./sec after annealing.

In one embodiment, silicon (Si) and aluminum (Al) may be contained so as to satisfy the following equation 1:

$$1.5 \leq (Si)+(Al) \leq 3.0 \quad \text{Equation 1}$$

wherein Si and Al represent the contents (wt %) of silicon (Si) and aluminum (Al), respectively, in the steel slab.

In one embodiment, titanium (Ti) and niobium (Nb) may be contained so as to satisfy the following equation 2:

$$0.01 \leq (Ti)+(Nb) \leq 0.02 \quad \text{Equation 2}$$

wherein Ti and Nb represent the contents (wt %) of titanium (Ti) and niobium (Nb), respectively, in the steel slab.

Another aspect of the present invention is directed to a coated steel sheet produced by the above-described method for producing the coated steel sheet. In one embodiment, the steel sheet contains 0.15-0.25 wt % of carbon (C), more than 0 wt % but not more than 1.5 wt % of silicon (Si), 1.5-2.5 wt % of manganese (Mn), more than 0 wt % but not more than 1.8 wt % of aluminum (Al), 0.3-1.0 wt % of chromium (Cr), more than 0 wt % but not more than 0.03 wt % of titanium (Ti), more than 0 wt % but not more than 0.03 wt % of niobium (Nb), and the balance of iron (Fe) and unavoidable impurities.

In one embodiment, the coated steel sheet may have a complex structure comprising, in terms of cross-sectional area ratio, 50-70 vol % of bainite, 10-25 vol % of ferrite, 5-20 vol % of martensite and 5-15 vol % of retained austenite.

In one embodiment, the coated steel sheet may have a tensile strength (YS) of 850-950 MPa, a yield strength of (TS) of 1180-1350 MPa, and an elongation (EL) of 10-20%.

Advantageous Effects

A coated steel sheet produced using a method for producing a coated steel sheet according to the present invention may have excellent crash energy absorption properties and mechanical strengths and may also have excellent forming properties such as bending and drawing properties.

MODE FOR INVENTION

Hereinafter, the present invention will be described in detail. In the following description, the detailed description of related known technology or constructions will be omitted when it may unnecessarily obscure the subject matter of the present invention.

In addition, the terms used in the following description are terms defined taking into consideration their functions in the present invention, and may be changed according to the intention of a user or operator, or according to a usual practice. Accordingly, the definition of these terms must be made based on the contents throughout the specification.

One aspect of the present invention is directed to a method for producing a coated steel sheet.

Figure 1:
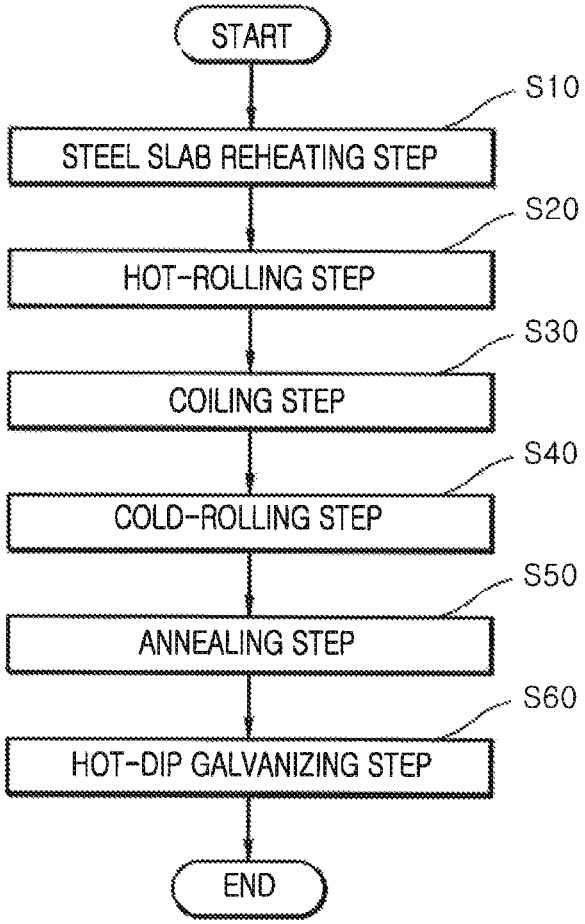
FIG. 1 shows a method for producing a coated steel sheet according to an embodiment of the present invention.

FIG. 1 shows a method for producing a coated steel sheet according to an embodiment of the present invention. Referring to FIG. 1, the method for producing the coated steel sheet according to an embodiment includes: a steel slab reheating step (S10); a hot-rolling step (S20); a coiling step (S30); a cold-rolling step (S40); an annealing step (S50); and a hot-dip galvanizing step (S60).

More specifically, step (S10) of the method for producing the coated steel sheet includes reheating a steel slab containing 0.15-0.25 wt % of carbon (C), more than 0 wt % but not more than 1.5 wt % of silicon (Si), 1.5-2.5 wt % of manganese (Mn), more than 0 wt % but not more than 1.8 wt % of aluminum (Al), 0.3-2.0 wt % of chromium (Cr), more than 0 wt % but not more than 0.03 wt % of titanium (Ti), more than 0 wt % but not more than 0.03 wt % of niobium (Nb), and the balance of iron (Fe) and unavoidable impurities.

In step (S20), the steel slab is hot-rolled at a finish-rolling temperature of Ar3 to Ar3+100° C.

In step (S30), the hot-rolled steel slab is coiled to produce a hot-rolled coil.

In step (S40), the hot-rolled coil is uncoiled and cold-rolled, thereby producing a cold-rolled steel sheet.

In step (S50), the cold-rolled steel sheet is annealed, cooled, and then tempered.

In a specific embodiment, the annealing may be performed in a two-phase region between the AC1 temperature and the AC3 temperature, and then the annealed steel sheet may be cooled at a cooling rate of, for example, 10° C./sec to 50° C./sec. Herein, the finish cooling temperature is the Ms temperature or higher. Next, the steel sheet may be tempered at a temperature between 450° C. and 550° C.

In step (S60), the annealed cold-rolled steel sheet is hot-dip galvanized.

Hereinafter, each step of the method for producing the coated steel sheet according to the present invention will be described in detail.

(S10) Step of Reheating Steel Slab

This step is a step of reheating a steel slab. More specifically, this step is a step of reheating a steel slab containing 0.15-0.25 wt % of carbon (C), more than 0 wt % but not more than 1.5 wt % of silicon (Si), 1.5-2.5 wt % of manganese (Mn), more than 0 wt % but not more than 1.8 wt % of aluminum (Al), 0.3-2.0 wt % of chromium (Cr), more than 0 wt % but not more than 0.03 wt % of titanium (Ti), more than 0 wt % but not more than 0.03 wt % of niobium (Nb), and the balance of iron (Fe) and unavoidable impurities.

Hereinafter, the role and content of each component contained in the steel slab will be described in detail.

Carbon (C)

Carbon (C), an interstitial solid solution element, serves to ensure the concentration of carbon in retained austenite (Cret: 0.6-0.7 wt %) to thereby stabilize austenite. Carbon is contained in an amount of 0.15-0.25 wt % based on the total weight of the steel slab. When carbon is contained in this content range, it can have an excellent effect on austenite stabilization. If carbon is contained in an amount of less than 0.15 wt %, the concentration of carbon in austenite will decrease, and thus formation of retained austenite in a process of finally cooling the steel sheet to room temperature after alloying heat treatment can be inhibited, and if carbon is contained in an amount of more than 0.25 wt %, the strength and toughness of the steel sheet can be reduced or the weldability of the steel sheet can be reduced.

Silicon (Si)

Silicon (Si) serves as an element that stabilizes ferrite in the coated steel sheet. It can serve to refine ferrite to thereby increase the ductility of the steel sheet, and can inhibit formation of low-temperature carbides to thereby increase the concentration of carbon in austenite.

Silicon is contained in an amount of more than 0 wt % but not more than 1.5 wt % based on the total weight of the steel slab. When silicon is contained in this content range, it will increase in the concentration of carbon in austenite and will have an excellent effect on ferrite stabilization. If silicon is contained in an amount of more than 1.5 wt %, it will form oxides such as silicon oxide on the steel sheet surface to thereby reduce coatability in a hot-dip galvanizing process. For example, it may be contained in an amount of 0.5-1.0 wt %.

Manganese (Mn)

Manganese (Mn) serves as an austenite-stabilizing element that inhibits transformation of high-temperature ferrite and low-temperature bainite during cooling to thereby increase the fraction of martensite transformation during cooling.

Manganese is contained in an amount of 1.5-2.5 wt % based on the total weight of the steel slab. When manganese is contained in this content range, both the strength and formability of the coated steel sheet will be excellent. If manganese is contained in an amount of less than 1.5 wt %, the martensite transformation fraction will not be ensured, resulting in a decrease in the strength of the steel sheet, and if manganese is contained in an amount of 2.5 wt %, the strength of the steel sheet will be excessively increased, and thus the elongation of the steel sheet will be reduced.

Aluminum (Al)

Aluminum (Al), a ferrite-stabilizing element, can serve to refine ferrite to thereby increase the ductility of the steel sheet. In addition, it can serve to inhibit formation of low-temperature carbides to thereby increase the concentration of carbon in austenite.

Aluminum is contained in an amount of more than 0 wt % but not more than 1.8 wt % based on the total weight of the steel slab. When aluminum is contained in this content range, the steel sheet according to the present invention will have excellent ductility. If the steel slab contains no aluminum, the austenite fraction in the two-phase temperature region during annealing will increase rapidly to increase the variation in properties of the steel sheet, and the concentration of carbon in austenite will decrease rather than increase. If the content of aluminum is more than 1.8 wt %, problems will arise in that the AC3 transformation point increases so that the first heating temperature increases to a temperature higher than required, and in that the formation of AlN at the ferrite grain boundary is promoted to cause slab embrittlement. For example, aluminum may be contained in an amount of 0.5-1.0 wt %.

Chromium (Cr)

Chromium (Cr) is an element that expands the low-temperature bainite area. It is added for the purposes of inducing the development of Lath-type bainite structures in the coated steel sheet of the present invention and promoting the formation of stabilized retained austenite in the first heating, cooling and second heating processes according to the present invention.

Chromium is contained in an amount of 0.3-2.0 wt % based on the total weight of the steel slab. When chromium is contained in this content range, both the strength and formability of the steel sheet will be excellent. If chromium is contained in an amount of less than 0.3 wt %, it will be difficult to ensure retained austenite and strength, and if chromium is contained in an amount of more than 2.0 wt %, it will show the effect of reducing the ductility of the steel sheet by stabilizing low-temperature carbides.

Titanium (Ti) and Niobium (Nb)

Titanium (Ti) and niobium (Nb) can serve to form a TiNbC precipitate and refine grains during two-phase region heat-treatment to thereby improve bendability.

Each of niobium (Nb) and titanium (Ti) is contained in an amount of more than 0 wt % but not more than 0.03 wt % based on the total weight of the steel slab. When niobium (Nb) and titanium (Ti) are contained in such content ranges, they will have an excellent effect on grain refinement, and the steel sheet will have excellent formability. If the steel slab does not contains niobium and titanium, the effect of refining grains by a precipitate will be insignificant, and thus the effect of improving bendability will be reduced, and if each of niobium and titanium is contained in an amount of more than 0.03 wt %, a problem will arise in that the elongation of the steel sheet is reduced by a precipitate.

Phosphorus (P) and Sulfur (S)

Phosphorus (P) and sulfur (S) may be contained as unavoidable impurities in the steel slab of the present invention. Phosphorus can serve to increase the strength of the steel sheet by solid-solution strengthening and inhibit the formation of carbides.

In one embodiment, phosphorus may be contained in an amount of 0.015 wt % or less based on the total weight of the steel slab. When phosphorus is contained in this content range, the weldability and corrosion resistance of the steel sheet will be excellent. For example, phosphorus may be contained in an amount of more than 0 wt % but not more than 0.015 wt %.

Sulfur (S) can serve to form a fine MnS precipitate to thereby improve processability. In one embodiment, sulfur may be contained in an amount of 0.002 wt % or less based on the total weight of the steel slab. When sulfur is contained in this content range, the steel sheet will have excellent bendability. For example, sulfur may be contained in an amount of more than 0 wt % but not more than 0.002 wt %.

Nitrogen (N)

Nitrogen may be contained as an unavoidable impurity. Nitrogen may bond to niobium or the like to form carbonitride to thereby refine grains. However, nitrogen may be contained in an amount of 0.004 wt % or less. When nitrogen is contained in this content range, it can prevent the reduction in the crash energy absorption properties and elongation of the steel sheet. For example, nitrogen may be contained in an amount of more than 0 wt % but not more than 0.004 wt %.

In one embodiment of the present invention, silicon (Si) and aluminum (Al) that are contained in the steel slab may be contained so as to satisfy the following equation 1:

$$1.5 \leq (Si)+(Al) \leq 3.0 (wt\ \%) \quad \text{Equation 1}$$

wherein Si and Al represent the contents (wt %) of silicon (Si) and aluminum (Al), respectively, in the steel slab.

When silicon (Si) and aluminum (Al) are contained so as to satisfy equation 1, it will be easy to ensure the austenite fraction during two-phase region annealing, and thus the resulting steel sheet will have excellent properties. In one embodiment, the content of aluminum may be higher than the content of silicon in order to ensure coating properties.

In one embodiment, titanium (Ti) and niobium (Nb) that are contained in the steel slab may be contained so as to satisfy the following equation 2:

$$0.01 \leq (Ti)+(Nb) \leq 0.02 (wt\ \%) \quad \text{Equation 2}$$

wherein Ti and Nb represent the contents (wt %) of titanium (Ti) and niobium (Nb), respectively, in the steel slab.

When titanium (Ti) and niobium (Nb) are contained so as to satisfy equation 2, they will exhibit an excellent effect of refining grains during two-phase region annealing to thereby relive hydrogen embrittlement and improve bendability.

In one embodiment, the steel slab is reheated at a slab reheating temperature (SRT) between 1150° C. and 1250° C. At this steel slab reheating temperature, segregated components will sufficiently form a solid solution, and it will be easy to ensure strength.

(S20) Hot-Rolling Step

This step is a step of hot-rolling the steel slab at a finish-rolling temperature (FRT) of Ar3 to Ar3+100° C. If the hot rolling is performed at a temperature lower than the Ar3 temperature, the rolling will be performed in a two-phase region to cause a mixed grain structure, and if the hot-rolling temperature is higher than Ar3+100° C., the physical properties of the resulting steel sheet will be reduced due to grain coarsening.

In one embodiment, the steel slab may be hot-rolled at a finish-rolling temperature between 850° C. and 950° C. When the hot rolling is performed at this finish-rolling temperature, both the rigidity and formability of the coated steel sheet will be excellent.

(S30) Coiling Step

This step is a step of coiling the hot-rolled steel slab to thereby prepare a hot-rolled coil. In one embodiment, the coiling is performed by cooling and coiling the hot-rolled steel slab.

Herein, in order to prevent the surface enrichment of components (such as manganese and silicon) contained in the steel slab and the coarsening of carbides, the finish hot-rolled steel slab may be cooled by a shear quenching method and coiled, thereby producing a hot-rolled coil. In one embodiment, the hot-rolled steel slab may be cooled at a cooling rate of 5° C./sec to 100° C./sec and coiled at a coiling temperature (CT) of 400° C. to 550° C. When the coiling is performed at this temperature, excessive growth of grains will be inhibited, and the resulting steel sheet will have excellent ductility and formability.

(S40) Cold-Rolling Step

This step is a step of uncoiling and pickling the hot-rolled coil, followed by cold rolling, thereby producing a cold-rolled steel sheet. The pickling is performed for the purpose of removing scales from the hot-rolled coil produced by the above-described hot-rolling process.

The cold rolling may be performed at a reduction ratio of 50-80%. When the cold rolling is performed at this reduction ratio, the hot-rolled structure will be less deformed, and it will be easy to ensure the in-plane anisotropy index (Ar) value of the plastic strain ratio, and the steel sheet will have excellent elongation and formability.

(S50) Annealing Step

Figure 2:
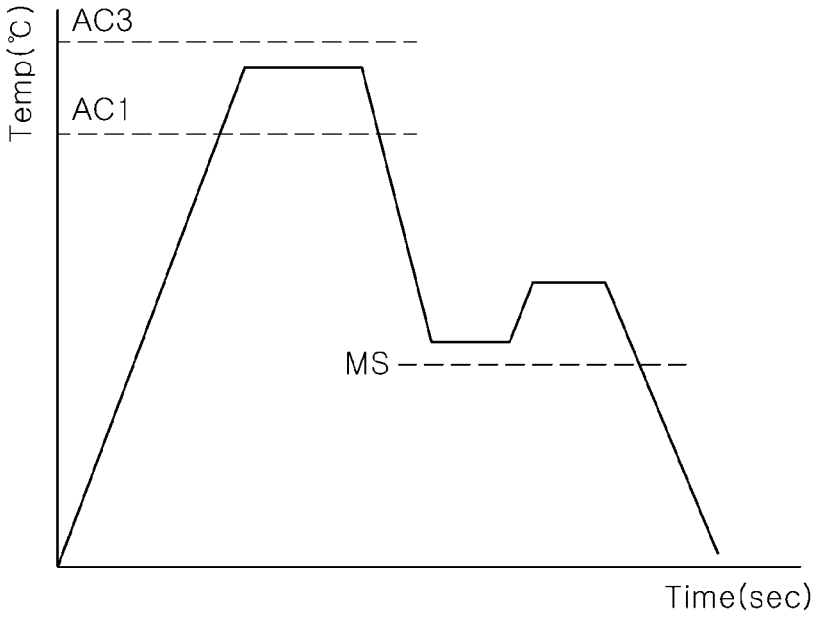
FIG. 2 is a graph showing a first heating schedule according to an embodiment of the present invention.

This step is a step of subjecting the cold-rolled steel sheet to annealing, quenching and then tempering. FIG. 2 is a graph showing a heat-treatment schedule according to one embodiment of the present invention. Referring to FIG. 2, the cold-rolled steel sheet is annealed by first heating at a two-phase region temperature between AC1 and AC3. Then, the annealed cold-rolled steel sheet is quenched to a temperature just higher than the Ms temperature, and the quenched cold-rolled steel sheet is tempered by second heating at a temperature between 450° C. and 550° C.

The annealing is performed by two-phase region heat treatment at a temperature of 820 to 870° C. If the annealing temperature is lower than 820° C., a sufficient initial austenite fraction cannot be obtained. On the other hand, if the annealing temperature is higher than 870° C., an annealing temperature higher than required is used, resulting in a decrease in economic efficiency.

After the annealing process, the cold-rolled steel sheet is cooled to a temperature just higher than the Ms temperature (martensite transformation start temperature). In a specific embodiment, the cold-rolled steel sheet is cooled at a finish-cooling temperature between 350° C. and 450° C. When the cold-rolled steel sheet is cooled at this temperature, microstructures will grow to prevent the reduction in strength. If the finish-cooling temperature is lower than 350°, the steel sheet will have increased strength and reduced processability, and if the finish-cooling temperature is higher than 450° C., it will be difficult to ensure the tensile strength of the steel sheet according to the present invention.

In one embodiment, the annealed cold-rolled steel sheet may be cooled at a cooling rate of 10 to 50° C./sec. In this cooling rate range, the uniformity of properties of the steel sheet will be excellent, and both the rigidity and formability of the steel sheet according to the present invention will be excellent.

The cooled cold-rolled steel sheet is tempered by second heating at a temperature between 450° C. and 550° C. When this tempering is performed, the fraction of retained austenite will increase, and both the mechanical strength and formability of the steel sheet will be excellent due to structure stabilization. If the tempering temperature is lower than 450° C., it will be difficult to obtain bainite and retained austenite structures, and if the tempering temperature is higher than 550° C., the formability of the steel sheet according to the present invention will be reduced.

(S60) Hot-Dip Galvanizing Step

This step is a step of hot-dip galvanizing the annealed and tempered cold-rolled steel sheet. In one embodiment, the hot-dip galvanizing may be performed by dipping the cold-rolled steel sheet in a zinc dip at a temperature of 450 to 510° C.

In one embodiment, the hot-dip galvanized cold-rolled steel sheet may be heat-treated for alloying. The heat treatment for alloying may be performed at a temperature ranging from 475° C. to 560° C. When the heat treatment for alloying is performed in the temperature range, the hot-dip galvanizing layer will be stably grown, and the steel sheet will have excellent coating adhesion.

Another aspect of the present invention is directed to a coated steel sheet produced by the method for producing the coated steel sheet. The coated steel sheet may contain, based on the total weight of the coated steel sheet, 0.15-0.25 wt % of carbon (C), more than 0 wt % but not more than 1.5 wt % of silicon (Si), 1.5-2.5 wt % of manganese (Mn), more than 0 wt % but not more than 1.8 wt % of aluminum (Al), 0.3-2.0 wt % of chromium (Cr), more than 0 wt % but not more than 0.03 wt % of titanium (Ti), more than 0 wt % but not more than 0.03 wt % of niobium (Nb), and the balance of iron (Fe) and unavoidable impurities.

In one embodiment of the present invention, silicon (Si) and aluminum (Al) that are contained in the steel slab may be contained so as to satisfy the following equation 1:

$$1.5 \leq (Si)+(Al) \leq 3.0 (wt\ \%) \qquad \text{Equation 1}$$

wherein Si and Al represent the contents (wt %) of silicon (Si) and aluminum (Al), respectively, in the steel slab.

When silicon (Si) and aluminum (Al) are contained so as to satisfy equation 1, the coated steel sheet will have excellent properties. In one embodiment, the content of aluminum may be higher than the content of silicon in order to ensure coating properties. In this condition, the coated steel sheet will have excellent coating adhesion.

In one embodiment, titanium (Ti) and niobium (Nb) that are contained in the steel slab may be contained so as to satisfy the following equation 2:

$$0.01 \leq (Ti)+(Nb) \leq 0.02 (wt\ \%) \qquad \text{Equation 2}$$

wherein Ti and Nb represent the contents (wt %) of titanium (Ti) and niobium (Nb), respectively, in the steel slab.

When titanium (Ti) and niobium (Nb) are contained so as to satisfy equation 2, they will exhibit an excellent effect of improving the bendability of the coated steel sheet.

In one embodiment, the coated steel sheet can ensure a stable retained austenite fraction, and thus has excellent strength and elongation. The coated steel sheet may contain acicular ferrite and bainite.

In one embodiment, the coated steel sheet may have a complex structure comprising, in terms of cross-sectional area ratio, 50-70 vol % of bainite, 10-25 vol % of ferrite, 5-20 vol % of martensite and 5-15 vol % of retained austenite.

In the coated steel sheet which is produced using the above-described content of chromium (Cr) in the steel slab and the annealing and tempering processes performed under the above-described conditions, retained austenite in a laminar form is formed in bainite. In addition, because chromium has the effect of expanding the bainite area, the fraction of transformation to bainite will increase, and the shape of retained austenite will gradually change to a film shape having an increased concentration of retained austenite, and thus the steel sheet will have excellent elongation.

In one embodiment, the coated steel sheet may have a tensile strength (YS) of 850-950 MPa, a yield strength of (TS) of 1180-1350 MPa, an elongation (EL) of 10-20%, and a yield ratio (YR) of 65-75%. In such ranges, the crash energy absorption property, formability and rigidity of the coated steel sheet will all be excellent.

The coated steel sheet produced using the method for producing the coated steel sheet according to the present invention will be excellent in terms of crash energy absorption properties, mechanical strength, bendability, and forming properties such as bending and drawing properties.

Hereinafter, the construction and operation of the present invention will be described in further detail with reference to preferred examples. However, these examples are only preferred examples of the present invention and are not intended to limit the scope of the present invention in any way.

Example 1

A steel slab, containing components in the amounts shown in Table 1 below and the balance of iron (Fe) and unavoidable impurities, was reheated at a slab reheating temperature of 1,220° C. The reheated steel slab was hot-rolled at a finish-rolling temperature of 860° C., cooled to 450° C. and coiled, thereby producing a hot-rolled coil. The hot-rolled coil was uncoiled, pickled, and then cold-rolled at a reduction ratio of 70%, thereby producing a cold-rolled steel sheet. Under the conditions shown in Table 2 below, the cold-rolled steel sheet was annealed, quenched and tempered. The tempered steel sheet was hot-dip galvanized, thereby producing a coated steel sheet.

Example 2

A coated steel sheet was produced in the same manner as described in Example 1, except that a steel slab having the components and contents shown in Table 1 was used.

Comparative Examples 1 to and 3

Steel slabs containing components in the amounts shown in Table 1 below were used. Under the conditions shown in Table 2 below, the produced cold-rolled steel sheets of Comparative Examples 1 and 3 were annealed, and then cooled. The steel sheets of Comparative Examples 1 and 3 were hot-dip galvanized in the same manner as described in Example 1, thereby producing hot-dip galvanized steel sheets.

Comparative Example 4

A steel slab containing components in the amounts shown in Table 1 below was used. Under the conditions shown in Table 2 below, the produced cold-rolled steel sheet was annealed, and then cooled. Then, the steel sheet was tempered at a temperature of 580° C. Next, the steel sheet was hot-dip galvanized in the same manner as described in Example 1, thereby producing a hot-dip galvanized steel sheet.

TABLE 1

| | Components (unit: wt %) | | | | | | | | | |
|---|---|---|---|---|---|---|---|---|---|---|
| | C | Mn | Cr | P | S | Al | Si | Ti | Nb | N |
| Example 1 | 0.18 | 1.5 | 1.5 | 0.015 | 0.002 | 1 | 0.8 | 0.01 | 0.005 | 0.004 |
| Example 2 | 0.18 | 1.5 | 1.0 | 0.015 | 0.002 | 1 | 0.8 | 0.01 | 0.005 | 0.004 |
| Comparative Example 1 | 0.18 | 2.5 | — | 0.015 | 0.002 | 1 | 0.8 | 0.01 | 0.005 | 0.004 |
| Comparative Example 3 | 0.18 | 2.5 | — | 0.015 | 0.002 | 1 | 0.8 | 0.01 | 0.005 | 0.004 |
| Comparative Example 4 | 0.18 | 2.5 | 1.5 | 0.015 | 0.002 | 1 | 0.8 | 0.01 | 0.005 | 0.004 |

TABLE 2

| Annealing | First heating temperature (° C.) | Finish-cooling temperature (° C.) | Cooling rate (° C./sec) | Second cooling temperature (° C.) |
|---|---|---|---|---|
| Example 1 | 850 | 390 | 30 | 450 |
| Example 2 | 850 | 390 | 30 | 450 |
| Comparative Example 1 | 850 | 390 | 30 | — |
| Comparative Example 3 | 850 | 390 | 30 | — |
| Comparative Example 4 | 850 | 390 | 30 | 580 |

The microstructure distribution, tensile strength (MPa), yield strength (MPa), elongation (%), yield ratio (%) and bendability of each of the coated steel sheets produced in Examples 1 and 2 and Comparatives Examples 1, 3 and 4 were measured, and the results of the measurement are shown in Table 3 below.

TABLE 3

| | | | | | Microstructures (vol %) | | | | Retained austenite | | 90° |
|---|---|---|---|---|---|---|---|---|---|---|---|
| | YS (MPa) | TS (MPa) | EL (%) | YR (%) | martensite | ferrite | Bainite | Retained austenite | Shape (%) | C concentration | bendability (R/t) |
| Example 1 | 903 | 1263 | 16.9 | 71 | 19 | 19 | 53 | 9 | 16.9 | 0.61 | 1.12 |
| Example 2 | 894 | 1259 | 18.2 | 71 | 16 | 20 | 52 | 12 | 18.2 | 0.68 | 1.12 |
| Comp. Example 1 | 712 | 1252 | 14.2 | 57 | 35 | 19 | 42 | 4 | 14.2 | 0.43 | 4.3 |
| Comp. Example 3 | 652 | 1194 | 17.8 | 55 | 31 | 32 | 34 | 3 | 17.8 | 0.53 | 5 |
| Comp. Example 4 | 638 | 1101 | 15.3 | 58 | 15 | 34 | 44 | 7 | 15.3 | 0.67 | 2.8 |

As can be seen from the results in Table 3 above, the coated steel sheets of Example 1 and 2 according to the present invention had a microstructure comprising 50-70% bainite 50~70%, 10-25% ferrite, 5-20% martensite and 5-15% retained austenite, and showed a tensile strength of 890 MPa or higher and an elongation of 16% or higher, indicating that both the impact strength and formability of the steel sheets were excellent. However, in the case of the steel sheet of Comparative Example 1 containing no chromium, the forming properties (such as bendability) were inferior to those of Examples 1 and 2, and the tensile strength was also lower than those of Examples 1 and 2. In addition, in the case of Comparative Example 3 in which the second heating process in annealing was not performed and in the case of Comparative Example 4 in which the second heating temperature in annealing was out of the range specified in the present invention, the formability and rigidity of the steel sheets were reduced.

Simple modifications or alterations of the present invention can be easily made by those skilled in the art, and such modifications or alternations are all considered to fall within the scope of the present invention.

The invention claimed is:

1. A method for producing a coated steel sheet, comprising the steps of:

(a) reheating a steel slab containing 0.15-0.25 wt % of carbon (C), more than 0 wt % but not more than 1.5 wt % of silicon (Si), 1.5-2.5 wt % of manganese (Mn), more than 0 wt % but not more than 1.8 wt % of aluminum (Al), 0.3-2.0 wt % of chromium (Cr), more than 0 wt % but not more than 0.03 wt % of titanium (Ti), more than 0 wt % but not more than 0.03 wt % of niobium (Nb), and a balance of iron (Fe) and unavoidable impurities;

(b) hot-rolling, cooling and coiling the steel slab, thereby producing a hot-rolled steel sheet;

(c) pickling the hot-rolled steel sheet, followed by cold rolling;

(d) annealing the cold-rolled steel sheet at a temperature between 820° C. and 870° C., followed by cooling at a rate of 10 degrees C. to 15 degrees C. per second to a finish-cooling temperature between 350° C. and 450° C.;

(e) tempering the cooled steel sheet at a temperature between 450° C. and 550° C.; and (f) hot-dip galvanizing the tempered steel sheet.

2. The method of claim 1, wherein the cold rolling is performed at a reduction ratio of 50-80%.

3. The method of claim 1, wherein silicon (Si) and aluminum (Al) are contained so as to satisfy the following equation:

$$1.5 \leq (Si)+(Al) \leq 3.0 \text{ (wt \%)}$$

wherein Si and Al represent the contents (wt %) of silicon (Si) and aluminum (Al), respectively, in the steel slab.

4. The method of claim 1, wherein titanium (Ti) and niobium (Nb) are contained so as to satisfy the following equation:

$$0.01 \leq (Ti)+(Nb) \leq 0.02 \text{ (wt \%)}$$

wherein Ti and Nb represent the contents (wt %) of titanium (Ti) and niobium (Nb), respectively, in the steel slab.

5. A method for producing a coated steel sheet, comprising the steps of:

(a) reheating a steel slab containing 0.15-0.25 wt % of carbon (C), more than 0 wt % but not more than 1.5 wt % of silicon (Si), 1.5-2.5 wt % of manganese (Mn), more than 0 wt % but not more than 1.8 wt % of aluminum (Al), 0.3-2.0 wt % of chromium (Cr), more than 0 wt % but not more than 0.03 wt % of titanium (Ti), more than 0 wt % but not more than 0.03 wt % of niobium (Nb), and a balance of iron (Fe) and unavoidable impurities;

(b) hot-rolling, cooling and coiling the steel slab, thereby producing a hot-rolled steel sheet;

(c) pickling the hot-rolled steel sheet, followed by cold rolling;

(d) annealing the cold-rolled steel sheet at an annealing temperature between 820° C. and 870° C., followed by cooling at a finish-cooling temperature between 350° C. and 450° C. directly from the annealing temperature;

(e) tempering the cooled steel sheet at a temperature between 450° C. and 550° C.; and (f) hot-dip galvanizing the tempered steel sheet.

6. The method of claim 1, wherein cooling at the finish cooling temperature includes quenching from the annealing temperature to the finish-cooling temperature.

7. The method of claim 5, wherein cooling at the finish cooling temperature includes quenching from the annealing temperature to the finish-cooling temperature.

* * * * *